US006597253B2

(12) United States Patent
Umegaki

(10) Patent No.: US 6,597,253 B2
(45) Date of Patent: Jul. 22, 2003

(54) NONRECIPROCAL CIRCUIT DEVICE AND COMMUNICATION APPARATUS INCLUDING THE SAME

(75) Inventor: Toshihito Umegaki, Ishikawa-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/865,226

(22) Filed: May 25, 2001

(65) Prior Publication Data

US 2002/0030549 A1 Mar. 14, 2002

(30) Foreign Application Priority Data

May 26, 2000 (JP) ..... 2000-156048

(51) Int. Cl.[7] ..... H01P 1/383; H01P 1/36

(52) U.S. Cl. ..... 333/1.1; 333/24.2

(58) Field of Search ..... 333/1.1, 24.2; H01P 1/36, 1/383

(56) References Cited

U.S. PATENT DOCUMENTS 6,020,793 A * 2/2000 Makino et al. ..... 333/1.1
2002/0070819 A1 * 6/2002 Hasegawa ..... 333/1.1

FOREIGN PATENT DOCUMENTS

EP 0 903 802 A2 * 3/1999 ..... H01P/1/387
JP 06204712 A * 7/1994 ..... H01P/1/383
JP 10303605 A * 11/1998 ..... H01P/1/36
JP 11-298205 10/1999 ..... H01P/1/383

* cited by examiner

*Primary Examiner*—Justin P. Bettendorf
(74) *Attorney, Agent, or Firm*—Keating & Bennett, LLP

(57) ABSTRACT

A nonreciprocal circuit device includes a metal lower case made of magnetic metal, a resin terminal case, a central electrode assembly, a metal upper case made of magnetic metal, a permanent magnet, and an electric-circuit-component assembly. The electric-circuit-component assembly is disposed on a side of the permanent magnet, and is formed such that a coil and a capacitor are mounted on a substrate. The electric-circuit-component assembly is disposed in parallel to the thickness direction of the permanent magnet so as to be below the surface of the permanent magnet, and has a portion overlapping with the permanent magnet.

10 Claims, 5 Drawing Sheets

NONRECIPROCAL CIRCUIT DEVICE AND COMMUNICATION APPARATUS INCLUDING THE SAME

BACKGROUND OF THE INVENTION

1. Field of the Invention

The present invention relates to nonreciprocal circuit devices, and in particular, to a nonreciprocal circuit device such as an isolator or a circulator for use in microwave bands, and a communication apparatus including the nonreciprocal circuit device.

2. Description of the Related Art

In general, a lumped-constant isolator for use in a mobile communication apparatus such as a mobile phone has a function of allowing signals to pass only in a transmission direction so that a reverse transmission of the signals is prevented.

A lumped-constant isolator as shown in FIG. 7 is known (see Japanese Unexamined Patent Application Publication No. 11-298205) as a lumped-constant isolator of the above type. A lumped-constant isolator 200 in FIG. 7 includes a metal upper case 250 made of magnetic metal, a permanent magnet 260, a central electrode assembly 240, a terminal case 230, a metal lower case 220 made of magnetic metal, a spacer 280, a termination resistor R, and matching capacitors C11, C12, and C13.

The central electrode assembly 240 is formed such that three central electrodes 271 to 273 are arranged above a ferrite member 270 so as to cross at an angle of approximately 120 degrees with respect to one another, with an insulating sheet provided therebetween. On the upper surface of the spacer 280, an inductor pattern L10 is formed. The inductor pattern L10 and an external capacitor (not shown) outside the isolator 200 which is electrically connected to the isolator 200 constitute a band-pass filter. This band-pass filter is connected to the input side of the isolator 200, and has a function of reducing a high frequency distortion and unnecessary radiation by increasing the amount of attenuation out of the operating frequency of the isolator 200, particularly in high frequency bands (the second harmonic and the third harmonic).

As for conventional mobile communication apparatuses, a reduction in thickness and weight is in great demand, due to their uses. This is accompanied by a demand for a reduction in the heights of isolators. In one method for meeting the demand, it is possible that the distance between the central electrode assembly 240 and the permanent magnet 260 be reduced. However, by reducing the distance between the central electrode assembly 240 and the permanent magnet 260, a problem occurs in that a space for the spacer 280 provided with the inductor pattern L10 cannot be secured.

Because the inductor of the band-pass filter must be disposed in a small space between the central electrode assembly 240 and the permanent magnet 260, the inductor is limited to a planar type. Accordingly, it is impossible to employ, as the inductor of the band-pass filter, a wire-wound inductor and a laminated inductor (chip inductor) which have large heights. This causes a small degree of freedom in band-pass filter design.

SUMMARY OF THE INVENTION

Accordingly, it is an object of the present invention to provide a nonreciprocal circuit device having a low height and a high degree of freedom in design, and a communication apparatus including the nonreciprocal circuit device.

To this end, according to an aspect of the present invention, there is provided a nonreciprocal circuit device including: a permanent magnet; a ferrite member to which a direct current magnetic field is applied by the permanent magnet, the ferrite member having a plurality of central electrodes; an electric-circuit-component assembly electrically connected to at least one of central electrodes, the electric-circuit-component assembly including at least one electric circuit component; a resin case for accommodating the central electrodes, the electric-circuit-component assembly, and the ferrite member; and a metal case for accommodating the permanent magnet, the ferrite member, and the central electrodes, wherein the electric-circuit-component assembly is provided on a side of the permanent magnet; and the electric-circuit-component assembly is disposed below the upper surface of the permanent magnet in parallel to the thickness direction of the permanent magnet and has a portion overlapping with the permanent magnet.

Preferably, the electric-circuit-component assembly includes an inductor.

The inductor may be one of a wire-wound inductor and a laminated inductor.

The permanent magnet may be either square or circular.

The electric-circuit-component assembly may be one of a low-pass filter, a high-pass filter, and a band-pass filter.

A communication apparatus according to another aspect of the present invention includes at least one of the above nonreciprocal circuit devices.

According to the above-described construction, the distance between the central electrode assembly and the permanent magnet can be reduced because the electric-circuit-component assembly is disposed on a side of the permanent magnet. This enables the nonreciprocal circuit device to have a low height.

By forming the permanent magnet in a shape such as a square or a circle so that the permanent magnet covers the ferrite member, the distribution of a direct current magnetic field applied to the ferrite member can be uniformly maintained.

The electric-circuit-component assembly includes one of a low-pass filter, a high-pass filter, and a band-pass filter, thereby having a function of reducing a high frequency distortion and unnecessary radiation by increasing the amount of attenuation out of the operating frequency of the nonreciprocal circuit device.

In addition, the communication apparatus includes the nonreciprocal circuit device having the above-described characteristics, whereby its thickness and weight can be reduced.

According to the present invention, by disposing an electric-circuit-component assembly on a side of a permanent magnet, the distance between a central electrode assembly and the permanent magnet can be reduced, whereby the heights of a nonreciprocal circuit device and a communication apparatus can be reduced. The electric-circuit-component assembly does not need to be provided in a small space between the permanent magnet and the central electrode assembly, so that electric circuit components such as an inductor do not need to be limited to a planar type, and a wire-wound inductor and a laminated inductor (chip inductor), which have large heights, can be employed. As a result, the degree of freedom in band-pass filter design increases.

DESCRIPTION OF THE PREFERRED EMBODIMENTS

A nonreciprocal circuit device according to an embodiment of the present invention and a communication apparatus including the nonreciprocal circuit device are described below with reference to the accompanying drawings.

Figure 1:
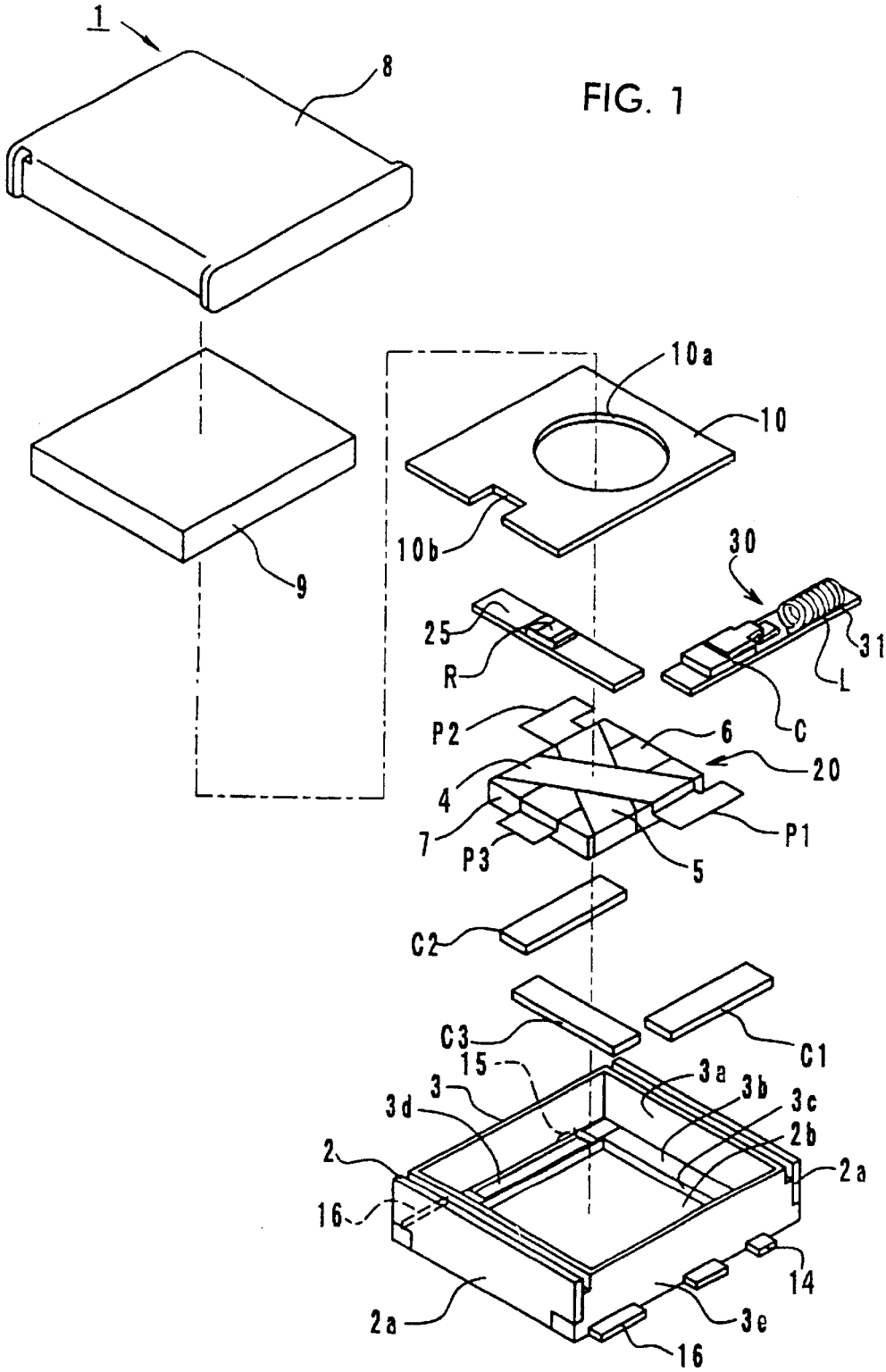
FIG. 1 is a perspective exploded view showing a nonreciprocal circuit device according to an embodiment of the present invention.
Figure 2:
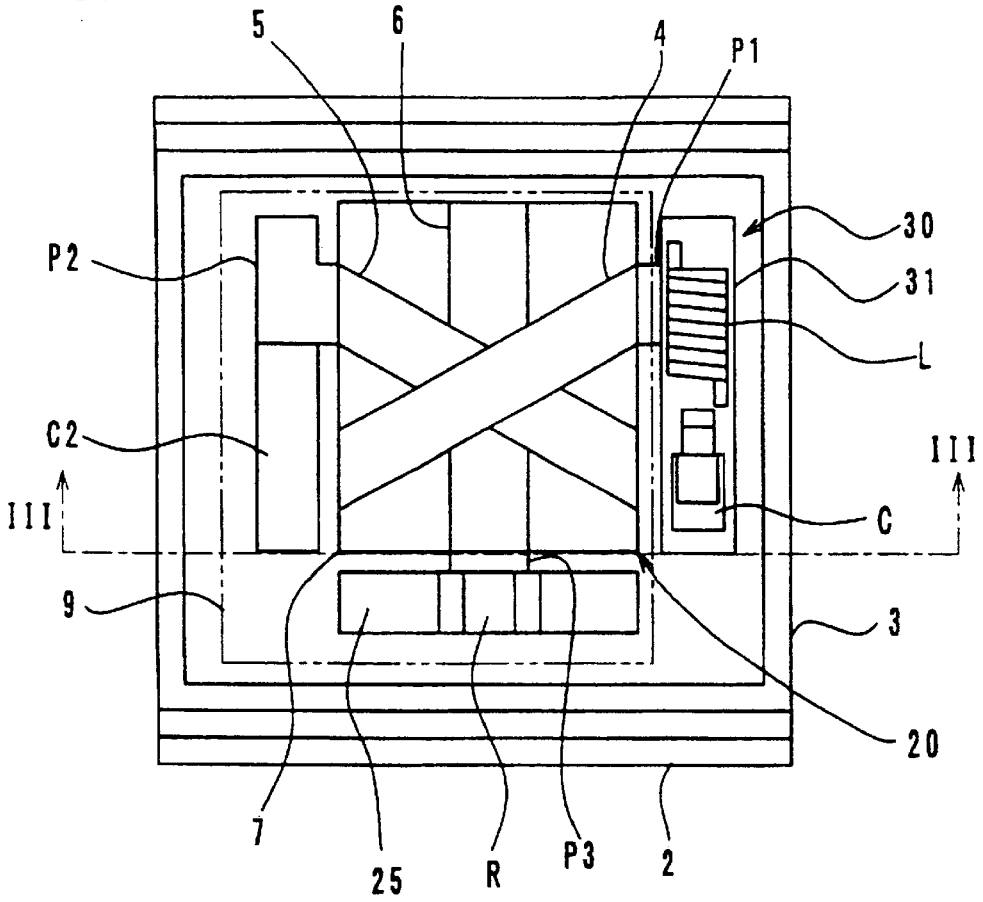
FIG. 2 is a schematic plan view showing the inside of the nonreciprocal circuit device shown in FIG. 1 in an assembled state.

Referring to FIGS. 1 and 2, a lumped-constant isolator 1 includes a metal lower case 2 made of magnetic metal, a resin terminal case 3, a central electrode assembly 20, a metal upper case 8 made of magnetic metal, a permanent magnet 9, an electric-circuit-component assembly 30, a termination resistor R, and matching capacitors C1, C2, and C3.

The central electrode assembly 20 is constructed such that three central electrodes 4 to 6 are arranged above the upper surface (one magnetic pole surface) of a rectangular microwave ferrite member 7 so as to cross at an angle of approximately 120 degrees with respect to one another, with an insulating sheet provided therebetween. Ports P1 to P3 at one end of the central electrodes 4 to 6 are positioned horizontally to the central electrodes 4 to 6. The central electrodes 4 to 6 form a common shielding portion 11 (see FIG. 3) at the other end thereof which abuts on the lower surface of the ferrite member 7. The common shielding portion 11 covers substantially all of the lower surface of the ferrite member 7.

The resin terminal case 3 is made of electrically insulating resin, and has a structure in which a bottom wall 3*b* is formed so as to be integrated with a rectangular side surface 3*a*. In the bottom wall 3*b*, a rectangular insertion hole 3*c* is formed. In the periphery of the insertion hole 3*c* on the bottom wall 3*b*, concave portions 3*d* for accommodating the matching capacitors C1 to C3 are formed.

The metal lower case 2 has right and left side surfaces 2*a* and a bottom wall 2*b*. On the metal lower case 2, the resin terminal case 3 is disposed. The central electrode assembly 20, which is rectangular, is inserted into the insertion hole 3*c* of the resin terminal case 3, and the common shielding portion 11 of the central electrode assembly 20 is electrically connected to the bottom wall 2*b* of the metal lower case 2 by a technique such as soldering so as to be grounded.

On the outside surfaces of side walls 3*e* of the resin terminal case 3, an input terminal 14 and an output terminal 15 for surface mounting, and ground terminals 16 are formed. One end of the input terminal 14 and one end of the output terminal 15 are exposed on the upper surfaces of the bottom wall 3*b* at the corners of the resin terminal case 3. Each end of the ground terminals 16 are exposed on the upper surfaces of each concave portion 3*d*. The terminals 14 to 16 are provided in the resin terminal case 3 by insert molding.

Hot-side capacitor electrodes on the upper surfaces of the matching capacitors C1 to C3 are electrically connected to the ports P1 to P3 for input/output, and cold-side capacitor electrodes are electrically connected to the ground terminals 16 which are exposed on the concave portions 3*d*. The port P1 of the central electrode 4 as one of the components constituting the central electrode assembly 20 is electrically connected to the input terminal 14 via the electric-circuit-component assembly 30. Similarly the port P2 of the central electrode 5 is electrically connected to the output terminal 15. The port P3 of the central electrode 6 is electrically connected to one end of the termination resistor R on a substrate 25. The other end of the termination resistor R is electrically connected to the ground terminal 16 (see FIG. 4).

Above the central electrode assembly 20, a spacer 10 is provided. The spacer 10 is used such that the permanent magnet 9 is disposed horizontally and stably in the isolator 1. By using the spacer 10, stable electric characteristics can be obtained. Almost in the center of the spacer 10 is formed an aperture 10*a* for accommodating a thick portion at which the central electrodes 4 to 6 are folded and mutually overlap in the central portion of the central electrode assembly 20. On an edge of the spacer 10, a notch 10*b* for accommodating the termination resistor R is formed.

Figure 4:
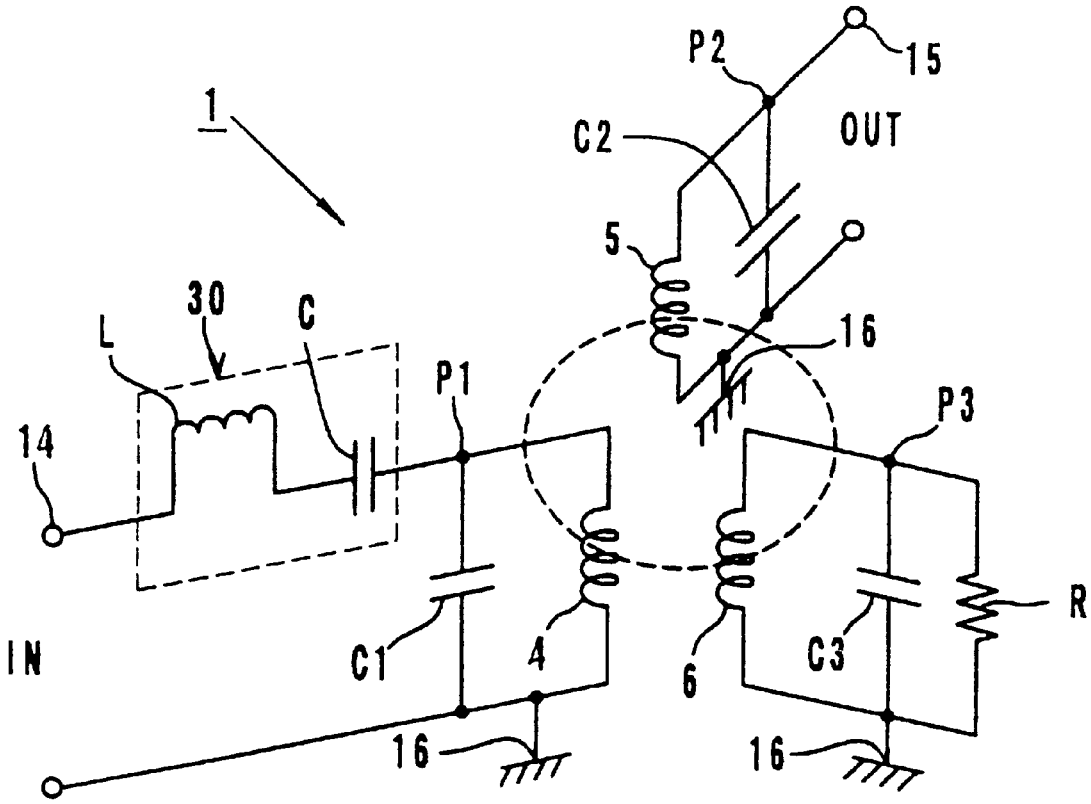
FIG. 4 is an electrically equivalent circuit diagram of the nonreciprocal circuit device shown in FIG. 1.

The electric-circuit-component assembly 30 has an inductor L and a capacitor C that are mounted on a substrate 31. The inductor L and the capacitor C are electrically connected in series to each other, whereby they constitute an LC resonant circuit. An end of the inductor L is electrically connected to the input terminal 14, and an end of the capacitor C is electrically connected to the port P1, whereby a band-pass filter is constituted. This band-pass filter is connected to the input side of the isolator 1, and has a function of reducing a high frequency distortion and unnecessary radiation by increasing the amount of attenuation out of the operating frequency of the isolator 1, particularly in high frequency bands (the second harmonic and the third harmonic). FIG. 4 is an electrically equivalent circuit of the isolator 1.

In the first embodiment, a case in which the electric-circuit-component assembly 30 forms a band-pass filter is described. However, the first embodiment is not limited thereto, but the electric-circuit-component assembly 30 may form a low-pass filter, a high-pass filter, etc.

Figure 3:
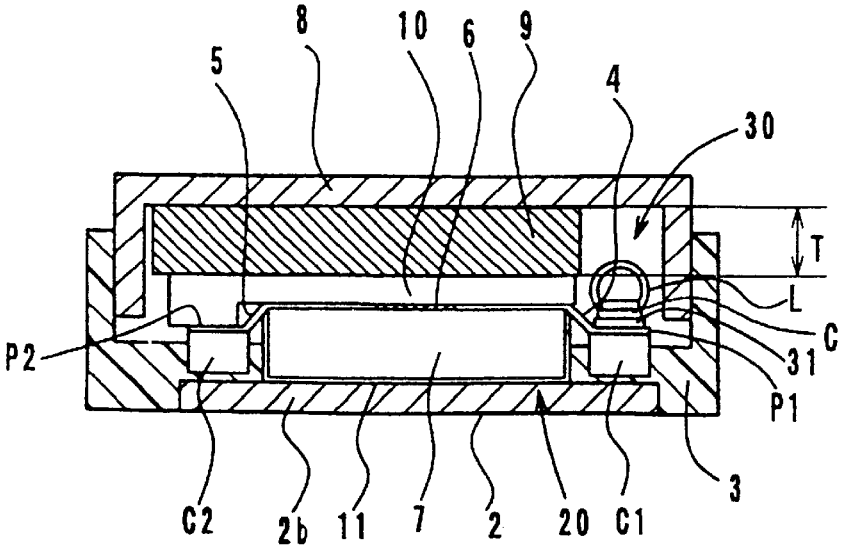
FIG. 3 is a sectional view taken on the line III—III shown in FIG. 2.

As shown in FIG. 3, the electric-circuit-component assembly 30 is disposed so that top portion thereof can be located within a range T between the upper surface and lower surface of the permanent magnet 9. In other words, the electric-circuit-component assembly 30, which is disposed on a side of the permanent magnet 9, is disposed below the upper surface of the permanent magnet 9 in parallel to the thickness direction of the permanent magnet 9, and has a portion overlapping the permanent magnet 9.

By employing the above-described construction, it is not necessary to provide the electric-circuit-component assembly 30 between the permanent magnet 9 and the central electrode assembly 20, and the thickness of the electric-circuit-component assembly 30 does not affect the determination of the thickness of the isolator 1. In other words, the thickness of the isolator 1 is determined by the sum of the thickness of the metal lower case 2, the thickness of the central electrode assembly 20, the thickness of the spacer 10, the thickness of the permanent magnet 9, and the thickness of the metal upper case 8.

Because the electric-circuit-component assembly 30 does not need to be provided in a narrow gap between the permanent magnet 9 and the central electrode assembly 20, it is not necessary to limit electric circuit components such as an inductor to those having planar shapes, and a wire-wound inductor and a laminated inductor (chip inductor), which have large heights, can be employed. As a result, the degree of freedom in band-pass filter design increases. In the first embodiment, an air-core wire-wound inductor is used as the inductor L, and a single plate capacitor in which capacitor electrodes made of sintered metal are provided on the surfaces of a dielectric substrate is used as the capacitor C.

As shown in FIG. 2, the permanent magnet 9 in the first embodiment is square in order to completely cover the upper surface of the central electrode assembly 20, so that a direct current magnetic field from the permanent magnet 9 is uniformly applied to the ferrite member 7. In addition, by disposing the permanent magnet 9 in the vicinity of the electric-circuit-component assembly 30, an area of a surface of the permanent magnet 9 which opposes the central electrode assembly 20 can be increased, and the distribution of the magnetic fields applied from the permanent magnet 9 can be uniformly maintained in the central electrode assembly 20.

Figure 5:
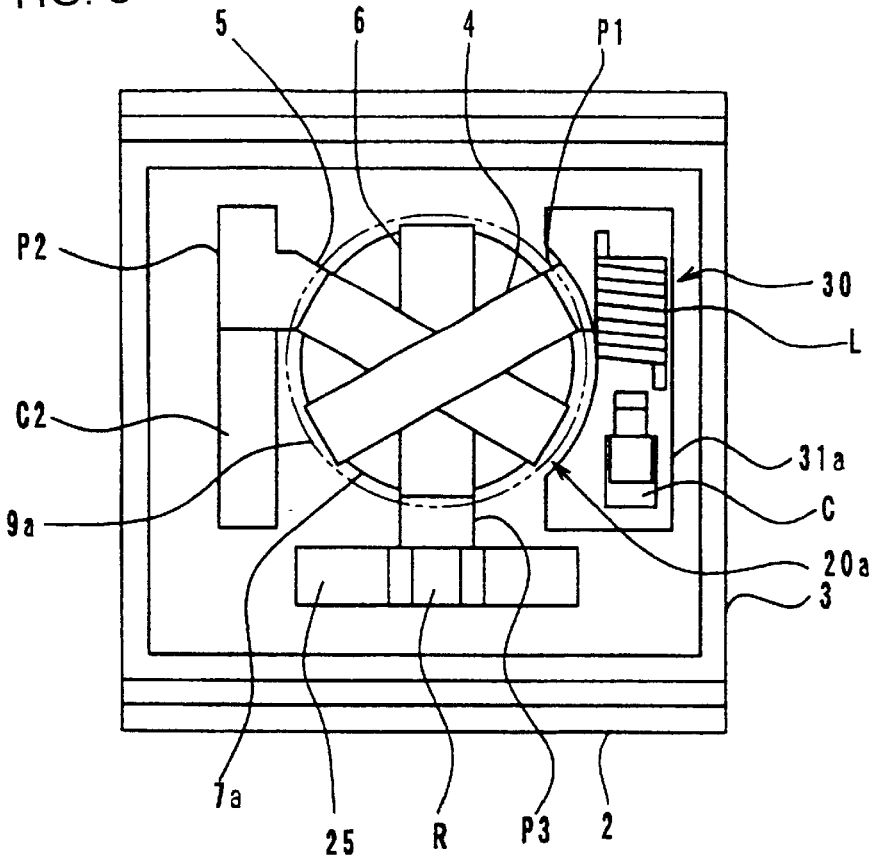
FIG. 5 is a schematic plane view showing a modification of the nonreciprocal circuit device shown in FIG. 1.

The shape of the permanent magnet 9 and the central electrode assembly 20 is not limited to a square, so a circular permanent magnet 9*a,* and a circular central electrode assembly 20*a* may be used, as shown in FIG. 5. In FIG. 5, a substrate 31*a* of an electric-circuit-component assembly 30 has a shape fitting the shape of the permanent magnet 9*a*.

In a second embodiment, a mobile phone as an example of a communication apparatus of the present invention is described below.

Figure 6:
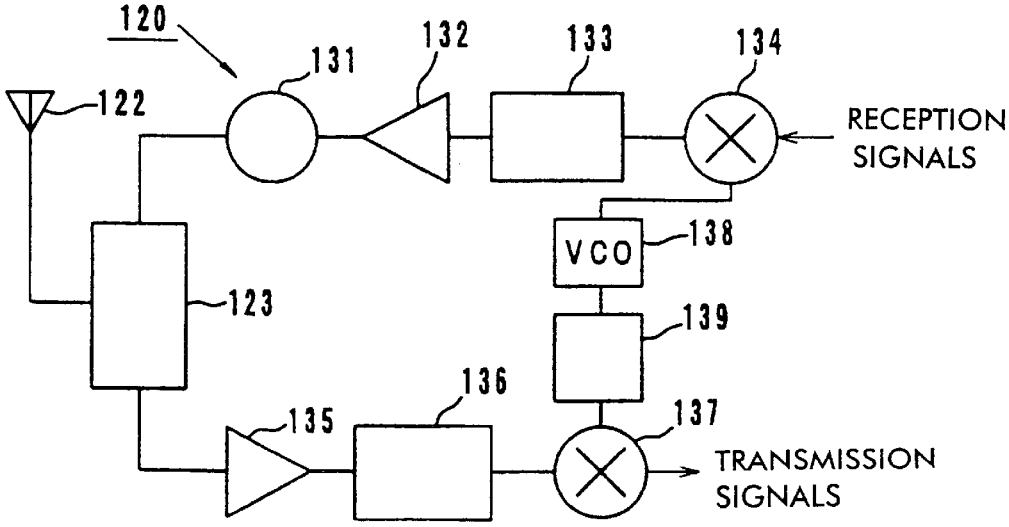
FIG. 6 is a block diagram showing a communication apparatus according to an embodiment of the present invention.
Figure 7:
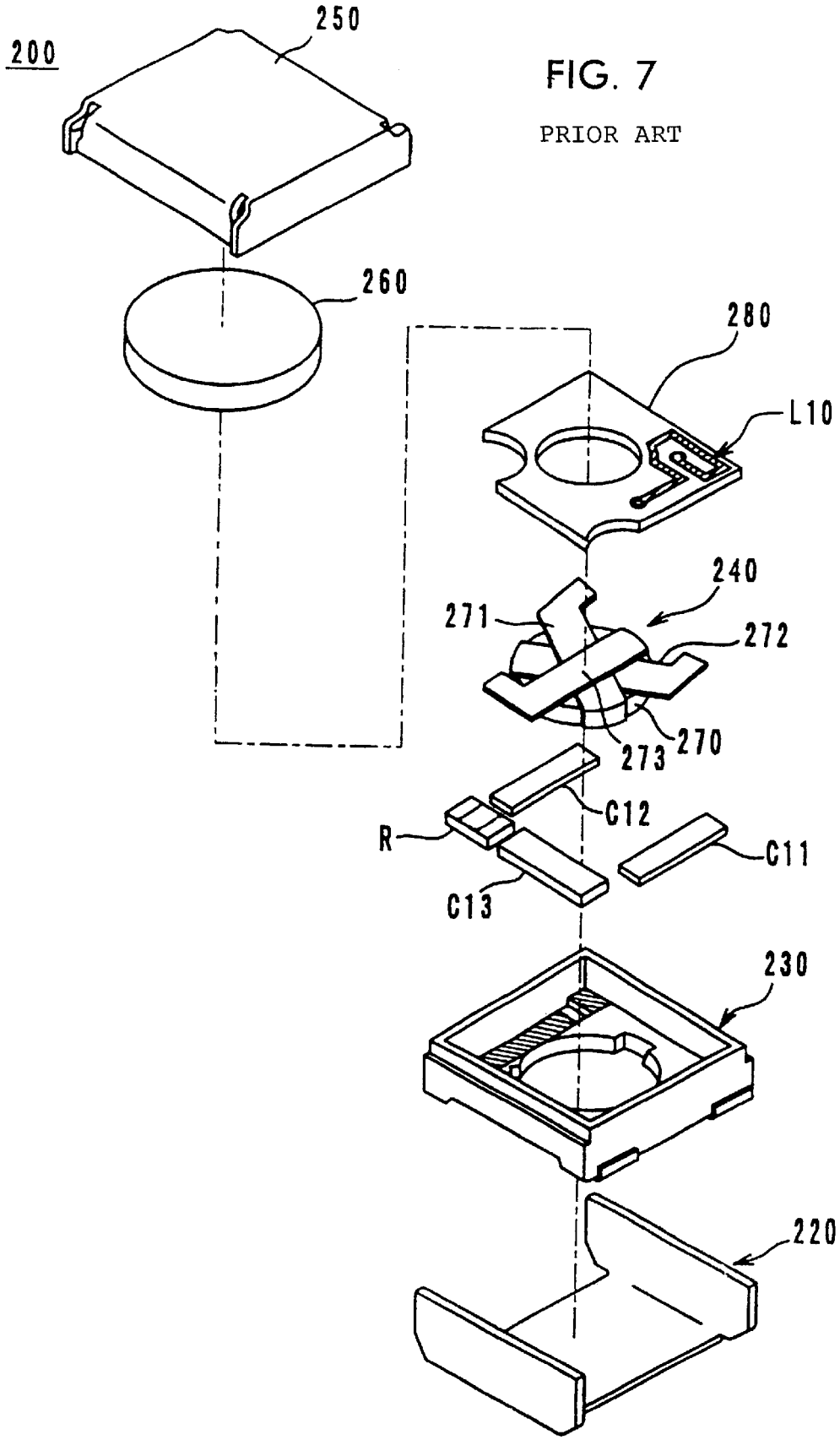
FIG. 7 PRIOR ART
FIG. 7 is a perspective exploded view showing a conventional nonreciprocal circuit device.

FIG. 6 is an electric circuit block diagram showing the RF part of a mobile phone 120. The RF part includes an antenna device 122, a duplexer 123, a transmitting isolator 131, a transmitting amplifier 132, a transmitting interstage band-pass filter 133, a transmitting mixer 134, a receiving amplifier 135, a receiving interstage band-pass filter 136, a receiving mixer 137, a voltage-controlled oscillator (VCO) 138, and a local band-pass filter 139.

The lumped-constant isolator 1 in the first embodiment can be used as the transmitting isolator 131. By mounting the isolator 1, a thin mobile phone having preferable communication characteristics is realized.

The present invention is not limited to the foregoing embodiments. By way of example, the mounting of the matching capacitors C1 to C3 may be performed using an electrically conductive adhesive instead of soldering. The matching capacitors C1 to C3 may be laminated capacitors. Also, the present invention may be applied to nonreciprocal circuit devices for use in high frequency components such as circulators other than isolators. Each of the central electrodes 4 to 6 may be formed not only by stamping and bending a metal sheet into a predetermined shape, but also by providing a pattern electrode on a substrate such as a dielectric substrate or a laminated substrate.

What is claimed is:

1. A nonreciprocal circuit device comprising:

a permanent magnet;

a ferrite member to which a direct current magnetic field is applied by said permanent magnet, said ferrite member having a plurality of central electrodes, each of said plurality of central electrodes including a port;

an electric-circuit-component assembly electrically connected to at least one of the central electrodes, said electric-circuit-component assembly including at least one electric circuit component;

a resin case for accommodating said central electrodes, said electric-circuit-component assembly, and said ferrite member; and a metal case for accommodating said permanent magnet, same ferrite member, and said central electrodes;

wherein said electric-circuit-component assembly is provided on a side of said permanent magnet and disposed on one of the plurality of ports so as to be electrically connected thereto; and said electric-circuit-component assembly is disposed below the upper surface of said permanent magnet in parallel to the thickness direction of said permanent magnet and has a portion overlapping with said permanent magnet.

2. A nonreciprocal circuit device according to claim 1, wherein said electric-circuit-component assembly includes an inductor.

3. A nonreciprocal circuit device according to claim 2, wherein said inductor is one of a wire-wound inductor and a laminated inductor.

4. A nonreciprocal circuit device according to one of claims 1 to 3, wherein said permanent magnet is either square or circular.

5. A nonreciprocal circuit device according to one of the claims 1 to 3, wherein said electric-circuit component assembly is one of a low-pass filter, a high-pass filter, and a band-pass filter.

6. A communication apparatus including a nonreciprocal circuit device according to on of claims 1 to 3.

7. A nonreciprocal circuit device according to claim 4, wherein said electric-circuit component assembly is one of a low-pass filter, a high-pass filter, and a band-pass filter.

8. A communication apparatus including a nonreciprocal circuit device according to claim 7.

9. A communication apparatus including a nonreciprocal circuit device according to claim 4.

10. A communication apparatus including a nonreciprocal circuit device according to claim 5.

* * * * *